US012780393B1

(12) United States Patent
Tornbaum et al.

(10) Patent No.: US 12,780,393 B1
(45) Date of Patent: Nov. 3, 2026

(54) SYSTEMS AND METHODS FOR AUTOMATIC TRANSITION BETWEEN OPERATIONAL MODES OF A MARINE PROPULSION CONTROL SYSTEM

(71) Applicant: Brunswick Corporation, Mettawa, IL (US)

(72) Inventors: Andres Perdomo Tornbaum, Neenah, WI (US); Kyle F. Karnick, Fond du Lac, WI (US); Timothy S. Reid, Eden, WI (US)

(73) Assignee: Brunswick Corporation, Mettawa, IL (US)

( * ) Notice: Subject to any disclaimer, the term of this patent is extended or adjusted under 35 U.S.C. 154(b) by 580 days.

(21) Appl. No.: 18/202,501

(22) Filed: May 26, 2023

(51) Int. Cl.

| | |
|---|---|
| ***B63H 25/42*** | (2006.01) |
| ***B63H 20/00*** | (2006.01) |
| ***B63H 25/02*** | (2006.01) |
| ***B63H 25/04*** | (2006.01) |

(52) U.S. Cl.
CPC ..... *B63H 25/42* (2013.01); *B63H 25/04* (2013.01); *B63H 2020/003* (2013.01); *B63H 2025/026* (2013.01)

(58) Field of Classification Search
CPC .. B63H 25/42; B63H 25/04; B63H 2025/026; B63H 2020/003
See application file for complete search history.

(56) References Cited

U.S. PATENT DOCUMENTS

| | | | | |
|---|---|---|---|---|
| 7,267,068 | B2 | 9/2007 | Bradley et al. | |
| 8,050,630 | B1 | 11/2011 | Arbuckle | |
| 8,417,399 | B2 | 4/2013 | Arbuckle et al. | |
| 8,622,777 | B1 * | 1/2014 | McNalley | B63H 21/22 440/53 |
| 8,694,248 | B1 | 4/2014 | Arbuckle et al. | |
| 8,924,054 | B1 * | 12/2014 | Arbuckle | G05D 1/0206 701/518 |
| 9,132,903 | B1 | 9/2015 | Gable et al. | |
| 9,377,780 | B1 | 6/2016 | Arbuckle et al. | |
| 9,733,645 | B1 | 8/2017 | Andrasko et al. | |
| 9,927,520 | B1 | 3/2018 | Ward et al. | |
| 10,198,005 | B2 | 2/2019 | Arbuckle et al. | |
| 10,633,307 | B2 | 4/2020 | Honore et al. | |
| 10,926,855 | B2 * | 2/2021 | Derginer | B63H 25/42 |
| 11,247,753 | B2 | 2/2022 | Arbuckle et al. | |
| 11,327,494 | B1 | 5/2022 | Arbuckle et al. | |
| 11,403,955 | B2 | 8/2022 | Derginer et al. | |

OTHER PUBLICATIONS

Derginer, Matthew E., Unpublished U.S. Appl. No. 17/869,533 for "Marine Propulsion System and Joystick Control Method", filed Jul. 20, 2022.

* cited by examiner

*Primary Examiner* — Stephen P Avila
(74) *Attorney, Agent, or Firm* — Andrus Intellectual Property Law, LLP

(57) ABSTRACT

A method for controlling propulsion of a marine vessel powered by a marine propulsion system including multiple marine drives is provided. The method includes determining at least one vessel characteristic while operating the marine drives according to a first operational mode, and switching to a second operational mode based on the at least one vessel characteristic. The method further includes receiving a user input from a user input device, interpreting the user input based on the second operational mode, and controlling a propulsion output of the marine drives according to the second operational mode.

11 Claims, 8 Drawing Sheets

SYSTEMS AND METHODS FOR AUTOMATIC TRANSITION BETWEEN OPERATIONAL MODES OF A MARINE PROPULSION CONTROL SYSTEM

FIELD

The present disclosure generally relates to propulsion control systems and methods for controlling propulsion of a marine vessel, and more specifically to systems and methods for automated transition between discrete operational modes of the propulsion control system.

BACKGROUND

The following U.S. Patents and Patent Application Publications are incorporated herein by reference, in entirety:

U.S. Pat. No. 10,198,005 discloses a method for controlling movement of a marine vessel that includes controlling a propulsion device to automatically maneuver the vessel along a track including a series of waypoints, and determining whether the next waypoint is a stopover waypoint at or near which the vessel is to electronically anchor. If the next waypoint is the stopover waypoint, a control module calculates a distance between the vessel and the stopover waypoint. In response to the calculated distance being less than or equal to a threshold distance, the propulsion device's thrust is decreased. In response to sensing that the vessel thereafter slows to a first threshold speed, the vessel's speed is further reduced. In response to sensing that the vessel thereafter slows to a second, lower threshold speed or passes the stopover waypoint, the propulsion device is controlled to maintain the vessel at an anchor point that is at or near the stopover waypoint.

U.S. Pat. No. 10,926,855 discloses a method for controlling low-speed propulsion of a marine vessel powered by a marine propulsion system having a plurality of propulsion devices includes receiving a signal indicating a position of a manually operable input device movable to indicate desired vessel movement within three degrees of freedom, and associating the position of the manually operable input device with a desired inertial velocity of the marine vessel. A steering position command and an engine command are then determined for each of the plurality of propulsion devices based on the desired inertial velocity and the propulsion system is controlled accordingly. An actual velocity of the marine vessel is measured and a difference between the desired inertial velocity and the actual velocity is determined, where the difference is used as feedback in subsequent steering position command and engine command determinations.

U.S. Pat. No. 11,247,753 discloses a method for maintaining a marine vessel at a global position and/or heading that includes receiving measurements related to vessel attitude and estimating water roughness conditions based on the measurements. A difference between the vessel's actual global position and the target global position and/or a difference between the vessel's actual heading and the target heading are determined. The method includes calculating a desired linear velocity based on the position difference and/or a desired rotational velocity based on the heading difference. The vessel's actual linear velocity and/or actual rotational velocity are filtered based on the roughness conditions. The method includes determining a difference between the desired linear velocity and the filtered actual linear velocity and/or a difference between the desired rotational velocity and the filtered actual rotational velocity.

The method also includes calculating vessel movements that will minimize the linear velocity difference and/or rotational velocity difference and carrying out the calculated movements.

U.S. Pat. No. 11,327,494 discloses a method for maintaining a marine vessel propelled by a marine propulsion device in a selected position that includes determining a current global position of the marine vessel and receiving a signal command to maintain the current global position. The current global position is stored as a target global position in response to receiving the signal command. A subsequent global position of the marine vessel is determined and a position error difference between the subsequent global position and the target global position is determined. The method includes determining marine vessel movements required to minimize the position error difference, and causing the marine propulsion device to produce a thrust having a magnitude, a direction, and an angle calculated to result in achievement of the required marine vessel movements. At least one of timing and frequency of discontinuity of thrust production is controlled while the position error difference is minimized.

U.S. Pat. No. 11,403,955 discloses a propulsion control system on a marine vessel that includes at least one propulsion device configured to propel the marine vessel and at least one proximity sensor system configured to generate proximity measurements describing a proximity of an object with respect to the marine vessel. The system further includes a controller configured to receive proximity measurements, access a preset buffer distance, and calculate a velocity limit in a direction of the object for the marine vessel based on the proximity measurements and the preset buffer distance so as to progressively decrease the velocity limit as the marine vessel approaches the preset buffer distance from the object.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to an exemplary implementation of the present disclosure, a method for controlling propulsion of a marine vessel powered by a marine propulsion system including multiple marine drives is provided. The method includes determining at least one vessel characteristic while operating the marine drives according to a first operational mode, switching to a second operational mode based on the vessel characteristic, and receiving a user input from a user input device. The method further includes interpreting the user input based on the second operational mode, and controlling a propulsion output of the marine drives according to the second operational mode.

According to another exemplary implementation of the present disclosure, a marine propulsion system for controlling propulsion of a marine vessel is provided. The system includes at least one marine drive configured to propel the marine vessel, a user input device; and a controller. The controller is configured to determine at least one vessel characteristic while operating the at least one marine drive according to a first operational mode and further switch to a second operational mode based on the at least one vessel characteristic. The controller is also configured to receive a user input from the user input device, interpret the user input based on the second operational mode, and control a propulsion output of the at least one marine drive according to the second operational mode.

Various other features, objects, and advantages of the invention will be made apparent from the following description taken together with the drawings.

BRIEF DESCRIPTION OF THE DRAWINGS

The present disclosure is described with reference to the following Figures.

DETAILED DESCRIPTION

The addition of sensors and imaging devices to marine vessels presents an opportunity to automatically tailor the control of the vessel propulsion in accordance with the data provided by such sensors and imaging devices. For example, when a vessel operator is employing vessel control at very low speeds near a dock structure, it is likely that the operator will need to make precise movements including lateral thrusts provided by the propulsion system of the marine vessel. However, once the vessel has gained some distance away from the dock structure and has increased in speed, it is likely that such lateral thrusts are no longer desired and the operator would prefer to be less precise in the movement of the joystick to achieve surge thrusts. Along the same lines, if the operator commands the vessel to enter a station keeping mode in close quarters with a dock structure or other vessels, it is likely that high precision control is desired to avoid collisions, even if it means more frequent operation of the propulsion system to maintain the vessel's location and/or heading. However, if the vessel is operating in station keeping in an open water setting where the risk of collision is low, the operator likely prioritizes minimization of noise, vibration, and harshness (NVH) to the occupants of the vessel, even if it means that the vessel is more likely to drift from a target location and/or heading. By automatically transitioning between these operational modes-docking mode, drive mode, low precision station keeping mode, and high precision station keeping mode-based on sensor data and other vessel characteristics, efficient control of the vessel is achieved and operator satisfaction is increased.

Figure 1:
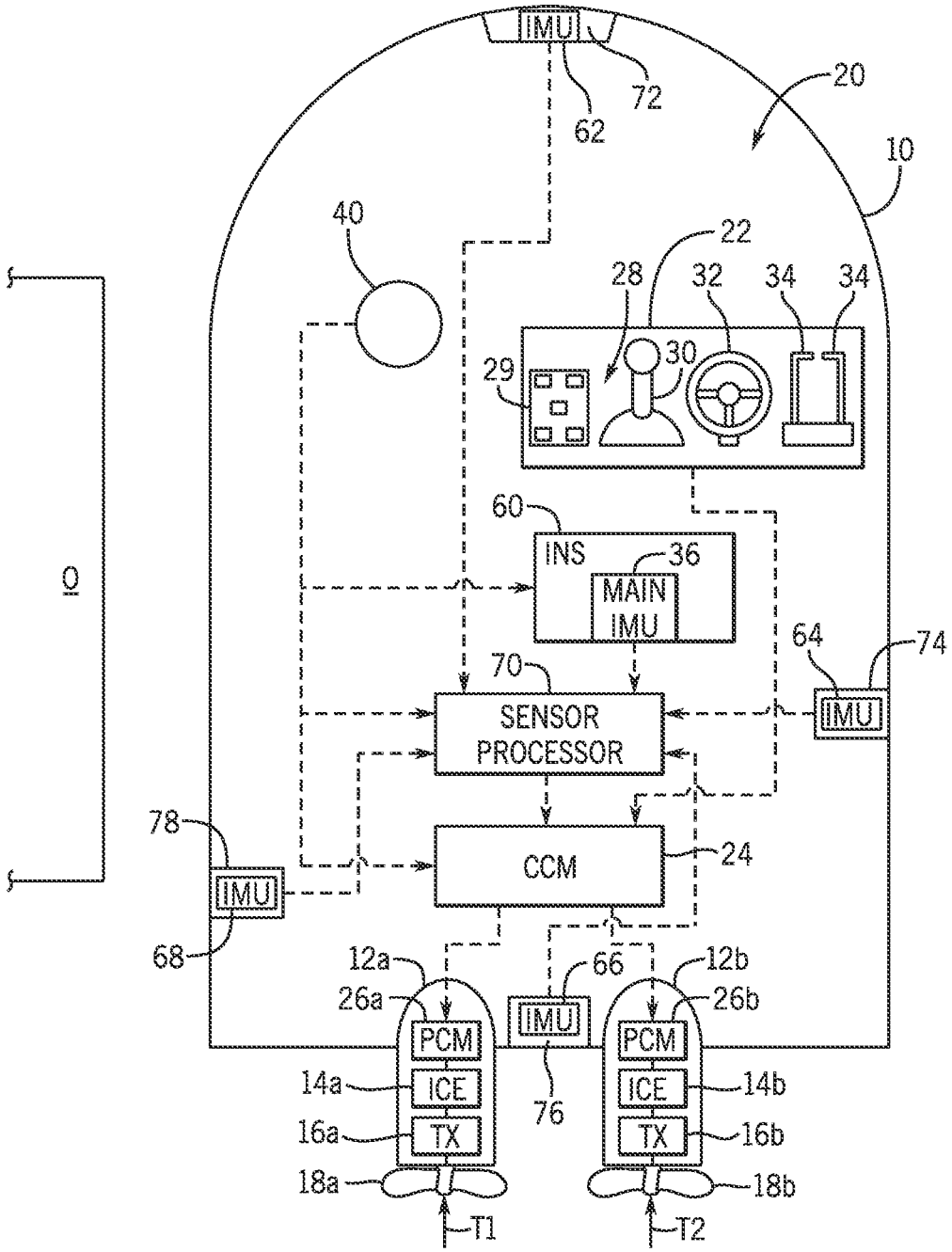
FIG. 1 is a schematic representation of an exemplary propulsion system on a marine vessel.

FIG. 1 shows a marine vessel 10 equipped with a propulsion control system 20 on a marine vessel 10 configured according to one embodiment of the disclosure. The propulsion system 20 has first and second marine drives12*a*, 12*b* that produce first and second thrusts T1, T2 to propel the vessel 10. The first and second marine drives 12*a*, 12*b* are illustrated as outboard motors, but they could alternatively be inboard motors, stern drives, jet drives, or pod drives. Each marine drive is provided with an engine 14*a*, 14*b* operatively connected to a transmission 16*a*, 16*b*, in turn, operatively connected to a propeller 18*a*, 18*b*. Although depicted herein as internal combustion engines, in other embodiments, the marine drives 12*a*, 12*b* could include electric motors powered by lithium-ion batteries, fuel cells, or any suitable alternative fuel source. In addition, although the marine vessel 10 is depicted as including two marine drives 12*a*, 12*b*, the systems and methods described herein could be utilized with any number of marine drives installed on the marine vessel 10.

The vessel 10 also houses various control elements that comprise part of the propulsion control system 20. The system 20 comprises an operation console 22 in signal communication, for example via a CAN bus as described in U.S. Pat. No. 6,273,771, with a controller 24, such as for example a command control module (CCM), and with propulsion control modules (PCM) 26*a*, 26*b* associated with the respective marine drives 12*a*, 12*b*. Each of the controller 24 and the PCMs 26*a*, 26*b* may include a memory and a programmable processor. As is conventional, each controller 24, 26*a*, 26*b* includes a processor communicatively connected to a storage system comprising a computer-readable medium that includes volatile or nonvolatile memory upon which computer readable code and data is stored. The processor can access the computer readable code and, upon executing the code, carry out functions, such as navigation control functions, proximity sensing functions, and docking control functions, as further described below.

The operation console 22 includes a number of user input devices, such as a keypad 29, a joystick 30, a steering wheel 32, and one or more throttle/shift levers 34. The operation console 22 may further include a display 28, such as may be associated with an onboard management system, that is configured to visually present information to the operator (e.g., information regarding control mode, control settings), present control options to the operator, and receive user input from the operator in response to the control options. One example of such a display system is VesselView by Mercury Marine Company of Fond du Lac, Wis. Each of these devices inputs commands to the controller 24. The controller 24, in turn, communicates control instructions to the first and second marine drives 12*a*, 12*b* by communicating with the PCMs 26*a*, 26*b*. The steering wheel 32 and the throttle/shift levers 34 function in a conventional manner such that rotation of the steering wheel 32, for example, activates a transducer that provides a signal to the controller 24 regarding a desired direction of the vessel 10, or, as described in further detail below, a vessel speed for an automated docking procedure. The controller 24, in turn, sends signals to the PCMs 26*a*, 26*b* (and/or TVMs or additional modules if provided), which in turn activate steering actuators to achieve desired orientations of the marine drives 12*a*, 12*b*. The marine drives 12*a*, 12*b* are independently steerable about their steering axes (e.g., steering axes 13*a*, 13*b*, see FIG. 4). The throttle/shift levers 34 send signals to the controller 24 regarding the desired gear (forward, reverse, or neutral) of the transmissions 16*a*, 16*b* and the desired rotational speed of the engines 14*a*, 14*b* of the marine drives 12*a*, 12*b*. The controller 24, in turn, sends signals to the PCMs 26*a*, 26*b*, which in turn activate electromechanical actuators in the transmissions 16*a*, 16*b* and engines 14*a*, 14*b* for shift and throttle, respectively. A manually operable input device, such as the joystick 30, can also be used to provide control input signals to the controller 24. The joystick 30 can be used to allow the operator of the vessel 10 to manually maneuver the vessel 10, such as to achieve lateral translation or rotation of the vessel 10. According to the systems and methods of the present disclosure described in further detail below, operation of the joystick 30 by an operator/user may also be utilized to control different parameters of an automated docking system (e.g., speed of an automated docking procedure, grant and revocation of authority to proceed with an automated docking procedure.)

The propulsion control system 20 also includes one or more proximity sensors 72, 74, 76, and 78. Although one proximity sensor is shown on each of the bow, stern, port and starboard sides of the vessel 10, fewer or more sensors could be provided at each location and/or provided at other locations, such as on the hardtop of the vessel 10. The proximity sensors 72-78 are distance and directional sensors. For example, the sensors could be radars, sonars, cameras, lasers (e.g. lidars or Leddars), Doppler direction finders, or other devices individually capable of determining both the distance and direction (at least approximately), i.e. the relative position of an object O with respect to the vessel 10, such as a dock, a seawall, a slip, another vessel, a large rock or tree, etc. In some embodiments, for example, as described below with respect to FIG. 10, the object O may be a seabed, such that the depth of water below the vessel 10 can be established. The sensors 72-78 provide information regarding both a direction of the object with respect to the marine vessel 10 and a shortest distance between the object O and the vessel 10. Alternatively, separate sensors could be provided for sensing direction than are provided for sensing distance, or more than one type of distance/direction sensor can be provided at a single location on the vessel 10. The sensors 72-78 provide this distance and/or direction information to one or more controllers, such as to the sensor processor 70 and/or the CCM 24, such as by way of a dedicated bus connecting the sensors to a controller, a CAN bus, or wireless network transmissions, as described in more detail below.

Regarding the proximity sensors, 72, 74, 76, 78, note that different types of sensors may be used depending on the distance between the vessel 10 and the object O. For example, radar sensors may be used to detect objects at further distances. Once the vessel 10 comes within a particular distance of the object, lidar, ultrasonic, Leddar, or sonar sensors may instead be used. Camera sensors may be used, alone or in combination with any of the sensors mentioned above, in order to provide object proximity information to the CCM 24. Sensors are placed at positions on the vessel 10 so that they are at the correct height and facing direction to detect objects the vessel 10 is likely to encounter. Optimal sensor positions will vary depending on vessel size and configuration.

In FIG. 1, the proximity sensors are positioned at each of the front, sides, and stern of the vessel 10, and include front-facing sensor 72, starboard-facing sensor 74, rear-facing sensor 76, and port-facing sensor 78. In a different exemplary sensor arrangement, two proximity sensors may be placed on the hard top of the marine vessel 10 and arranged such that the fields of view of the two sensors, combined, cover the entire 3600 area surrounding the vessel 10. Note also that the relevant controller, such as the sensor processor 70, may selectively operate any one or more of a plurality of sensors (including radars, lidars, Leddars, ultrasonics, and cameras) to sense the shortest distance and the direction of the object with respect to the vessel 10. Alternatively, the sensor processor may use all available sensor data from all sensor types, which may be reviewed real time as it is received or may be formulated into one or more maps or occupancy grids integrating all proximity measurement data, where the mapped data from all the operated sensors is processed as described herein. In such an embodiment, the proximity measurements from each of the various sensors are all translated into a common reference frame.

Autonomous and/or advanced operator assistance (i.e., semi-autonomous) controls for improved vessel handling qualities requires placement of multiple proximity sensors on the vessel 10. In general, these various types of proximity sensing devices (examples described above) are positioned to detect the presence of objects in the marine environment surrounding the marine vessel 10, such as a dock, swimmer, or other obstruction in the path of the vessel. Each sensor reports proximity relative to its own frame of reference—i.e. the distance from the sensor to the object as measured along the view angle of the sensor. Depending on the type of sensor, the application of use, boat size, hull shape, etc., multiple sensor types and sensor locations may be required to provide adequate proximity sensing around the marine vessel 10 for operation in all marine environments. To create a cohesive dataset that can be used for purposes of vessel control and vessel navigation, including automatic transition between operational modes, all of the data sources are preferably translated to a common reference frame. This requires precise knowledge of the location and orientation of each sensor relative to the common reference frame such that the data measured therefrom can be translated appropriately.

In the example of FIG. 1, a main inertial measurement unit (IMU) 36 is installed at a known location on the marine vessel with respect to a predefined point of navigation, such as the center of rotation (COR) or center of gravity (COG). The installation orientation or the main IMU 36 is also known. The installation locations of the main IMU 36 and each proximity sensor 72-78 are established as part of a calibration procedure for the proximity sensing system.

Referencing the example in FIG. 1, the main IMU 36 may be part of an inertial navigation system (INS) such as including one or more micro-electro-mechanical systems (MEMS). For example, the INS 60 may consist of a MEMS angular rate sensor, such as a rate gyro, a MEMS accelerometer, and a magnetometer. Such INS systems are well known in the relevant art. In other embodiments, the motion and angular position (including pitch, roll, and yaw) may be sensed by a differently configured INS 60, or by an attitude heading reference system (AHRS) that provides 3D orientation of the marine vessel 10 by integrating gyroscopic measurements, accelerometer data, and magnetometer data. The INS 60 receives orientation information from the main IMU 36 and may also receive information from a GPS receiver 40 comprising part of a global positioning system (GPS). The GPS receiver 40 is located at a pre-selected fixed position on the vessel 10, which provides information related to global position of the marine vessel 10. The main IMU 36 is also located at a known and fixed position with respect to the center of navigation determined for the marine vessel 10, such as the COR or COG.

In FIG. 1 an IMU 62-68 is co-located with each proximity sensor 72-78. These sensor IMUs 62-68 may be configured similarly to the main IMU, such as each comprising a rate gyro, an accelerometer, and a magnetometer and producing corresponding IMU data. The IMU data from each sensor IMU 62-68 may be used for various purposes, such as for automatic calibration and verification of the proximity sensor system, for angular measurements used to interpret the proximity measurements by the relevant proximity sensor 72-78, and/or as backup IMUs in case of fault or failure of the main IMU 36.

The autonomous or semi-autonomous control algorithms, such as effectuated by the controller 24, include velocity control software performing algorithms to calculate a maximum velocity for the marine vessel 10 as it approaches an object O. Where propulsion control is based on user input, the controller 24 calculates a maximum velocity for the vessel and effectuates velocity limits accordingly. In one embodiment, the velocity limits may be calculated based on a known maximum acceleration for the marine vessel. The maximum acceleration for the marine vessel may be based on the maximum vessel capabilities, such as the maximum positive or negative acceleration that can be effectuated by the propulsion system on the marine vessel 10 in the relevant direction of travel. Alternatively or additionally, the maximum acceleration for the marine vessel 10 may be predetermined, such as based on handling, comfort, or safety metrics.

In certain embodiments, the marine vessel 10 may be configured to autonomously control the marine drives 12*a*, 12*b* to maintain a predetermined buffer distance between the marine vessel 10 and the object O. Thus, where the predetermined buffer distance is violated, the relevant controller executing velocity control software 25, the propulsion controller, may generate instructions to the marine drives 12*a*, 12*b* to move the marine vessel such that the predetermined buffer distance is not violated. Further details regarding the maintenance of the predetermined buffer distance and calibration of maximum velocity are included in U.S. Patent Publication No. 2020/0247518, incorporated herein by reference in its entirety.

Figure 2:
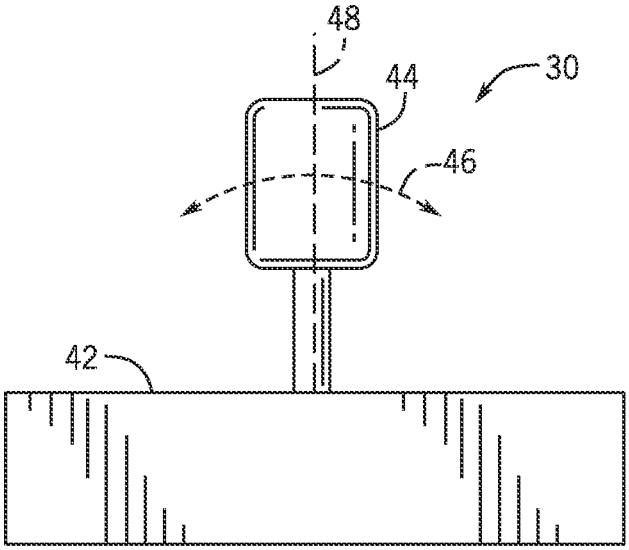
FIGS. 2 and 3 depict exemplary user input devices in accordance with various embodiments of the present disclosure.
Figure 3:
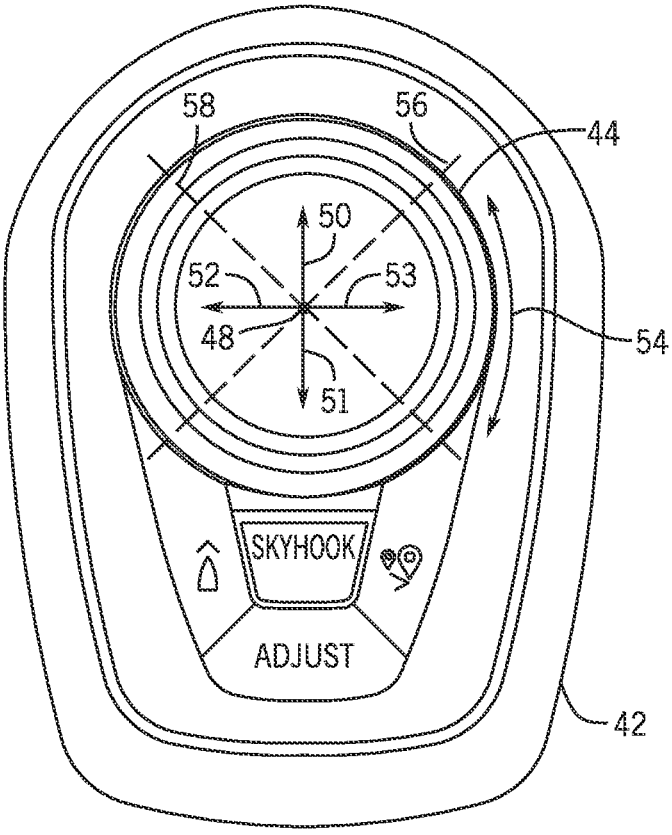

Referring now to FIGS. 2 and 3, operation of the joystick 30 according to the systems and methods of the present invention will now be described. FIG. 2 is a simplified schematic representation of the joystick 30 which provides a manually operable control device which can be used to provide a signal that is representative of a desired movement or docking user input of the marine vessel 10. The example in FIG. 2 shows a base portion 42 and a handle 44 which can be manipulated by a user's hand. In a typical application, the handle 44 is movable in the direction generally represented by arrow 46 and is also rotatable about an axis 48. It should be understood that the joystick handle 44 is movable by tilting it about its connection point in the base portion 42 in virtually any direction. Although arrow 46 is illustrated in the plane of the drawing in FIG. 2, a similar type of movement is possible in other directions that are not parallel to the plane of the drawing.

FIG. 3 is a top view of the joystick 30. The handle 44 can move, as indicated by arrow 46 in FIG. 2, in various directions which include those represented by arrows 50, 51, 52 and 53. However, it should be understood that the handle 44 can move in any direction relative to its axis 48 and is not limited to the two lines of movement represented by arrows 50, 51, 52 and 53. In fact, the movement of the handle 44 has a virtually infinite number of possible paths as it is tilted about its connection point within the base portion 42. The handle 44 is also rotatable about axis 48, as represented by arrow 54. Note that there are many different types of joystick devices that can be used to provide a signal that is representative of a desired movement of the marine vessel 10, as expressed by the operator of the marine vessel through movement of the handle 44. For example, a keypad, track ball, and/or other similar input device that allows inputs in four or more directions could be used.

With continued reference to FIG. 3, it can be seen that the operator can demand a purely linear movement (i.e., a sway movement) either toward port as represented by arrow 52 or starboard as represented by arrow 53, a purely linear movement (i.e., a surge movement) in a forward direction as represented by arrow 50 or reverse direction as represented by arrow 51, or any combination of two of these directions. In other words, by moving the handle 44 along dashed line 56, a linear movement toward the right side and forward or toward the left side and rearward can be commanded. Similarly, a linear movement along line 58 could be commanded. It should be understood that the operator of the marine vessel can also request a combination of sideways or forward/reverse linear movement in combination with a rotation as represented by arrow 54. Any of these possibilities can be accomplished through use of the joystick 30, which communicates with the CCM 24 and eventually with the PCMs 26*a*, 26*b*. As described in further detail below with reference to FIGS. 5 and 6, The magnitude, or intensity, of movement represented by the position of the handle 44 is also provided as an output from the joystick 30. In other words, if the handle 44 is moved slightly toward one side or the other, the commanded thrust in that direction is less than if, alternatively, the handle 44 was moved by a greater magnitude away from its vertical position with respect to the base portion 42. Furthermore, rotation of the handle 44 about axis 48, as represented by arrow 54, provides a signal representing the intensity of desired movement. A slight rotation of the handle 44 about axis 48 would represent a command for a slight rotational thrust about a preselected point on the marine vessel 10. On the other hand, a more intense rotation of the handle 44 about its axis 48 would represent a command for a higher magnitude of rotational thrust.

The joystick 30 can also provide information to the controller 24 regarding its being in an active state or an inactive state. While a user is manipulating the joystick 30, the joystick 30 is in an active state. However, if the operator releases the joystick 30 and allows its handle 44 to return to a centered/upright and neutral position, the joystick 30 reverts to an inactive state. In one example, movement of the handle 44 away from the centered state or rotation of the handle 44 about its axis 48, or both, causes the controller 24 to determine that the joystick 30 is in the active state and to subsequently act on the commands from the joystick 30, regardless of the position of the throttle/shift levers 34 or steering wheel 32.

Figure 4:
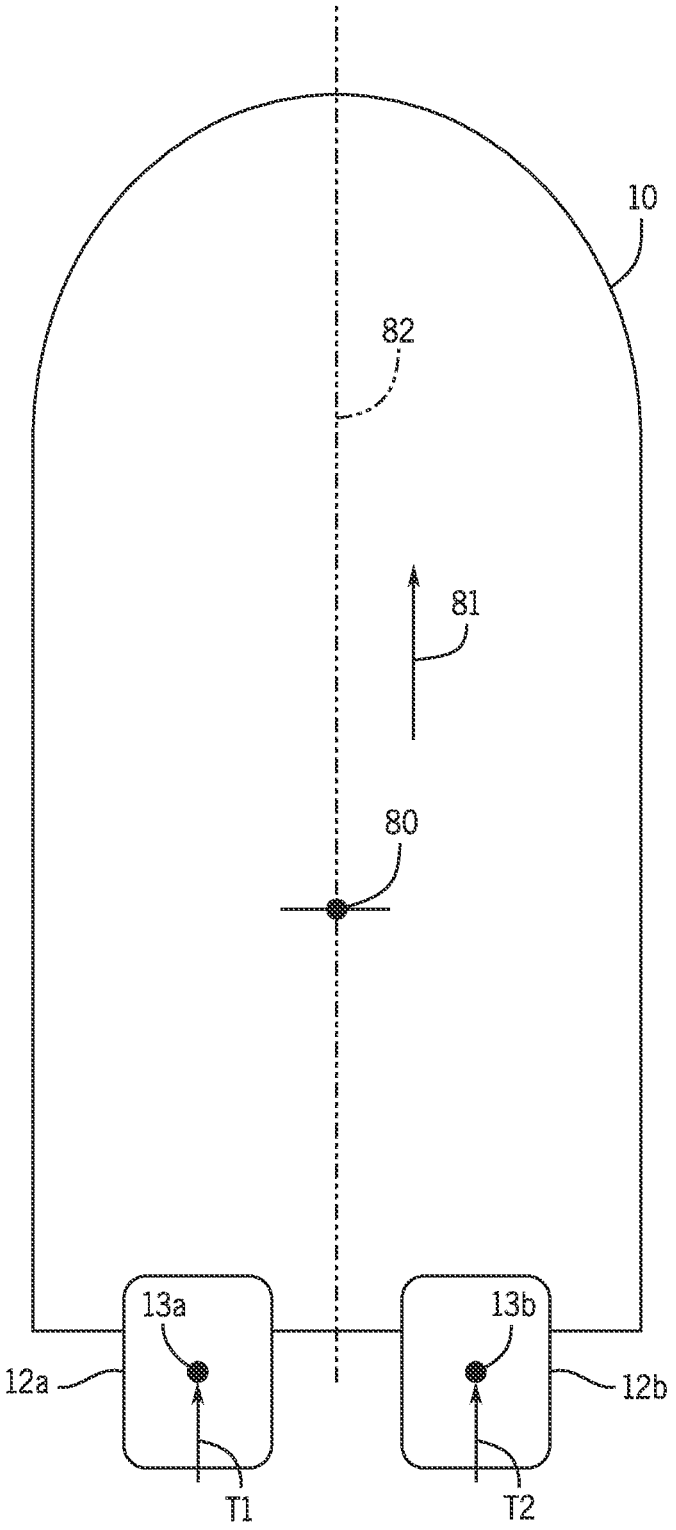
FIG. 4 illustrates an arrangement of thrust vectors during forward surge movement of the marine vessel.

Turning now to FIG. 4, the marine vessel 10 is illustrated schematically with its center of gravity 80, which can be a calibrated preselected point on the marine vessel 10. In other examples, point 80 could instead be an instantaneous center of turn. The center of turn is a function of several factors which comprise the speed of the vessel 10 as it moves through the water, the hydrodynamic forces on the hull of the marine vessel 10, the weight distribution of the load contained within the marine vessel 10, and the degree to which the vessel 10 is disposed below the waterline. The location of the center of turn can be empirically determined for various sets of conditions. For purposes of the below explanation, the point 80 will be referred to as the center of gravity, although similar calculations can be carried out using the center of turn.

First and second steering axes, 13*a* and 13*b*, are illustrated for the first and second marine drives 12*a*, 12*b*. The first and second marine drives 12*a*, 12*b* are rotatable about the first and second steering axes, 13*a* and 13*b*, respectively. The ranges of rotation of the first and second marine drives 12*a*, 12*b* may be symmetrical with respect to a centerline 82 of the vessel 10. The positioning method of the present disclosure rotates the first and second marine drives 12*a*, 12*b* about their respective steering axes 13*a*, 13*b*, adjusts their operation in forward or reverse gear, and adjusts the magnitude of their thrusts T1, T2 (for example, by adjusting engine speed and/or propeller pitch or transmission slip) in an efficient manner that allows rapid and accurate maneuvering of the marine vessel 10. The rotation, gear, and thrust magnitude of one marine drive 12*a* can be varied independently of the rotation, gear, and thrust magnitude of the other marine drive 12*b*.

FIG. 4 further illustrates a thrust orientation that is used when it is desired to move the marine vessel 10 in a forward direction (i.e., surge movement) represented by arrow 81, with no movement in either a right or left direction (i.e., sway movement) and no rotation (i.e., yaw movement) about its center of gravity 80. This is done by rotating the first and second marine drives 12*a*, 12*b* into an aligned position, in which their thrust vectors T1 and T2 are parallel to one another. As can be seen in FIG. 4, the first and second thrust vectors, T1 and T2, are equal in magnitude and are directed in the same forward direction. This creates no resultant rotation about the center of gravity 80 and no resultant movement in either the left or right directions. Movement in the direction represented by arrow 81 results from all of the vector components (described further herein below) of the first and second thrust vectors T1, T2 being resolved in a direction parallel to arrow 81. The resultant thrust components parallel to arrow 81 are additive and together provide net forward thrust in the direction of arrow 81 to the marine vessel 10. Although not depicted herein, in various embodiments, rotation of the first and second marine drives 12*a*, 12*b* about their respective steering axes 13*a*, 13*b* and operation of the first and second marine drives 12*a*, 12*b* in opposition (i.e., operation of the first marine drive 12*a* in forward gear to produce a forward thrust and operation of the second marine drive 12*b* in reverse gear to produce a reverse thrust) may be utilized to variably produce surge, sway, and yaw movements of the marine vessel 10. With reference to FIGS. 2-4, it can be seen that movement of the joystick handle 44 can be used by the operator of the vessel 10 to represent virtually any type of desired movement of the vessel 10 within three degrees of freedom—i.e., surge, sway, and yaw. In response to receiving a signal from the joystick 30, an algorithm determines whether or not a rotation about the COR 80 is requested by the operator. If forward translation with no rotation is requested, the first and second marine drives 12*a*, 12*b* are oriented so that their thrust vectors align in a forward parallel orientation, as shown in FIG. 4, and so long as the magnitude and direction of T1 are equal to that of T2, the vessel 10 will travel in a forward direction.

Figure 6:
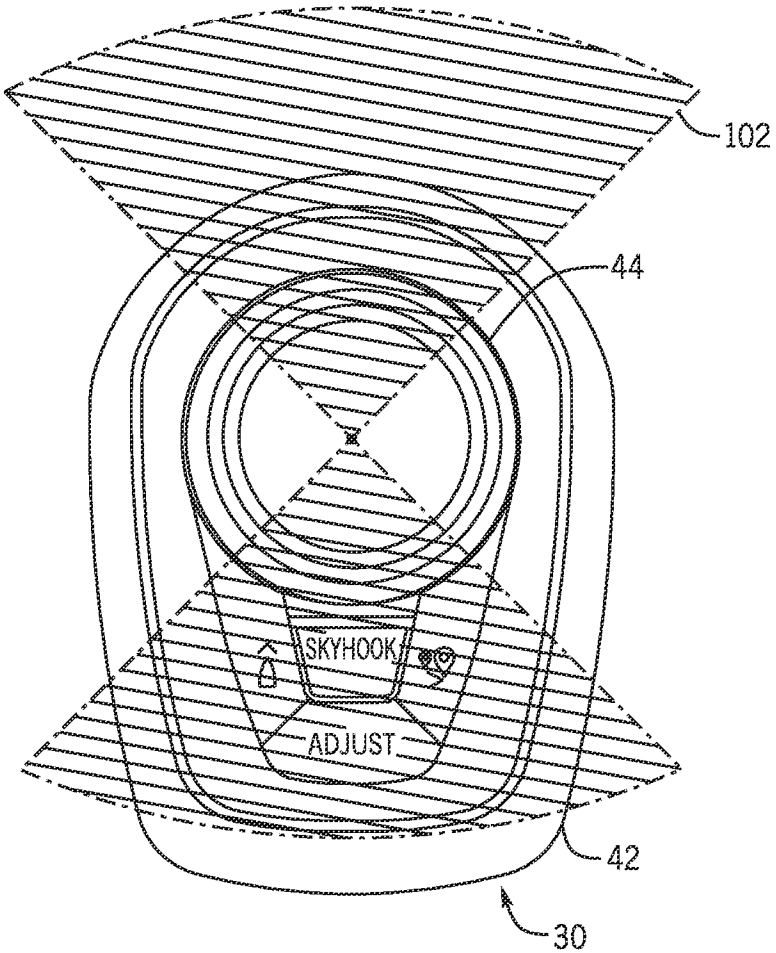
FIG. 6 illustrates a second range of movements of the user input device of FIGS. 2-3 that are assigned to surge movement of the marine vessel during operation in a drive mode.
Figure 5:
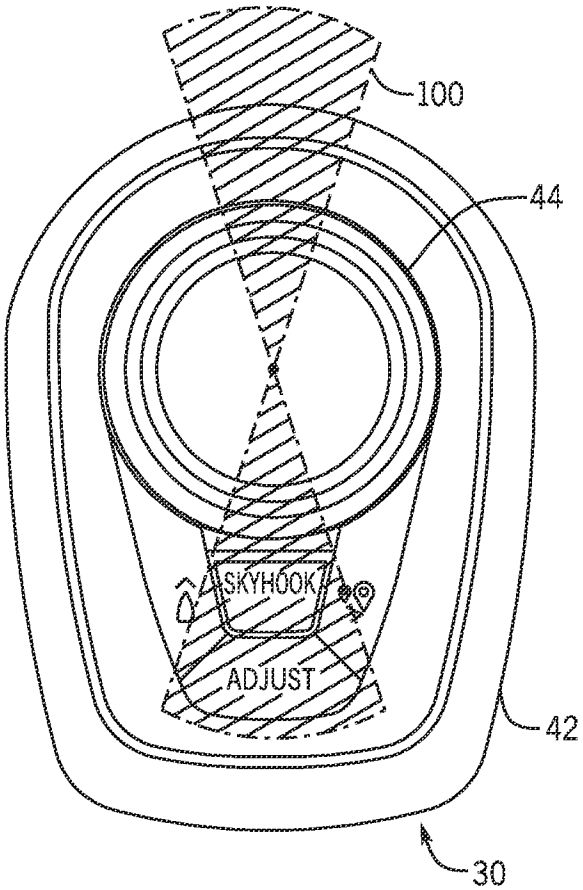
FIG. 5 illustrates a first range of movements of the user input device of FIGS. 2-3 that are assigned to surge movement of the marine vessel during operation in a docking mode.

FIGS. 5 and 6 illustrate the differences between respective operation of the propulsion control system 20 while joysticking in the docking and drive modes. Specifically, FIG. 5 depicts a first range 100 of movements of the handle 44 of the joystick 30 that are assigned to pure surge movement of the marine vessel 10 during operation in the docking mode, while FIG. 6 depicts a second range 102 of movements of the handle 44 of the joystick 30 that are assigned to pure surge movement of the marine vessel 10 during operation in the drive mode. In other words, when the propulsion control system 20 is operating in docking mode, it is assumed that the vessel 10 is more likely to require low speed sway and combined surge and sway (i.e., diagonal) movements that involve rotation of marine drives 12*a*, 12*b* about their steering axes 13*a*, 13*b* to efficiently maneuver into and away from a dock.

Accordingly, when the propulsion control system is operating in the docking mode, the CCM 24 will only interpret movements of the handle 44 within the first range 100 as an operator commanding pure forward or reverse surge movements, and movements of the handle 44 outside of the first range 100 will produce movements of the marine vessel 10 that include some sway component. By contrast, when the propulsion control system 20 is operating in the drive mode, the CCM 24 will interpret movements of the handle 44 within the second range 102 (that is, a broader range of movements of the handle 44 than the first range 100) as an operator commanding pure forward or reverse surge movements, and movements of the handle 44 outside of the second range 102 will produce movements of the marine vessel 10 that include some sway component. In this way, parallel steering of the marine drives 12*a*, 12*b* is effectuated in the drive mode to enable efficient vessel control during slow-speed maneuvers.

Figure 7:
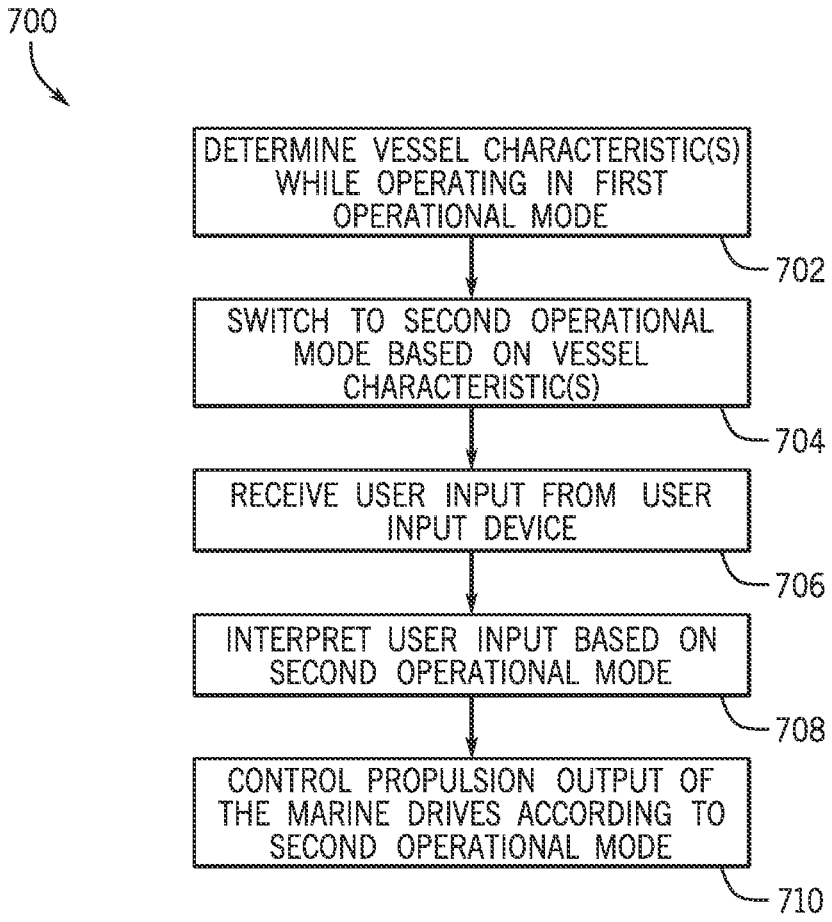
FIG. 7 illustrates a method of operating the propulsion system of the marine vessel during transition between operational modes.

Turning now to FIG. 7, a method 700 for operating the propulsion control system 20 of the marine vessel 10 during transition between operational modes is depicted. As described above, in various implementations, the operational modes include docking and drive modes, and high precision and low precision station keeping modes. In an exemplary implementation, method 700 may be performed predominantly by CCM 24 (see FIG. 1). Method 700 commences at step 702 as the CCM 24 determines one or more vessel characteristics while operating in a first operational mode. The one or more vessel characteristics may be based on sensor data (e.g., data received from IMUs 62-68 and proximity sensors 72-78) and may include, but are not limited to, a distance between the vessel 10 and an object O, a vessel speed, and conditions of the water proximate the vessel 10. For example, in various embodiments, the object O could be a dock structure, another marine vessel, or an obstacle in the water. In still further embodiments, the object O could be the seabed beneath the vessel 10, such that the sensed distance to the object O comprises a depth measurement for the body of water proximate the marine vessel 10.

At step 704, the CCM 24 switches to a second operational mode for the propulsion control system 20 based on the vessel characteristics detected in step 702. As described in further detail below with reference to FIGS. 8-10, switching to the second operational mode may be based on a comparison between the sensed vessel characteristics and one or more thresholds associated with the discrete operational modes that are stored in the CCM 24. For example, if the CCM 24 is operating the propulsion control system 20 in a docking mode (i.e., the first operational mode), a detected speed of the marine vessel 10 may be compared to a minimum drive speed threshold in order to determine whether to automatically transition to a drive mode (i.e., the second operational mode). In various embodiments, fulfillment of multiple criteria may be required to transition from a first operational mode to a second operational mode. Again returning to the example of operation in the docking mode, the CCM 24 may require both that the detected speed of the marine vessel 10 exceed a minimum drive speed threshold and that a detected distance between the marine vessel 10 and a designated object O exceed a minimum drive distance threshold before automatically transitioning to operation in the drive mode.

Continuing method 700 with step 706, the CCM 24 receives input from a user input device. In an exemplary embodiment, the user input device is a joystick 30, and the input is a movement of the handle 44. In various other embodiments, the user input could be actuation of a button on the keypad 29 or joystick 30 of the operation console 22, or rotation of the steering wheel 32. At step 708, the CCM 24 based on the second operational mode. For example, if the CCM 24 has transitioned operation from docking mode to drive mode at step 704, the CCM 24 will interpret a movement of the handle 44 of the joystick 30 according to the second range 102 (see FIG. 6) that is associated with the drive mode, such that any movement of the handle 44 within the second range 102 will be interpreted as an operator's desire to command pure forward or reverse surge movement.

Method 700 concludes at step 710 as the CCM 24 controls operation of the marine drives 12*a*, 12*b* according to the second operational mode. For example, if the second operational mode is the drive mode and at step 708 the operator moves the handle 44 of the joystick 30 within the second range 102, at step 710, the CCM 24 will command the marine drives 12*a*, 12*b* to provide pure surge thrust outputs having no sway component. As another example, if the second operational mode is a low precision station keeping mode intended to minimize NVH to the occupants of the marine vessel 10, at step 710, the CCM 24 will only operate the marine drives 12*a*, 12*b* to maintain a certain position and heading if an error associated with the position and/or heading exceeds error thresholds associated with the low precision station keeping mode.

Figure 8:
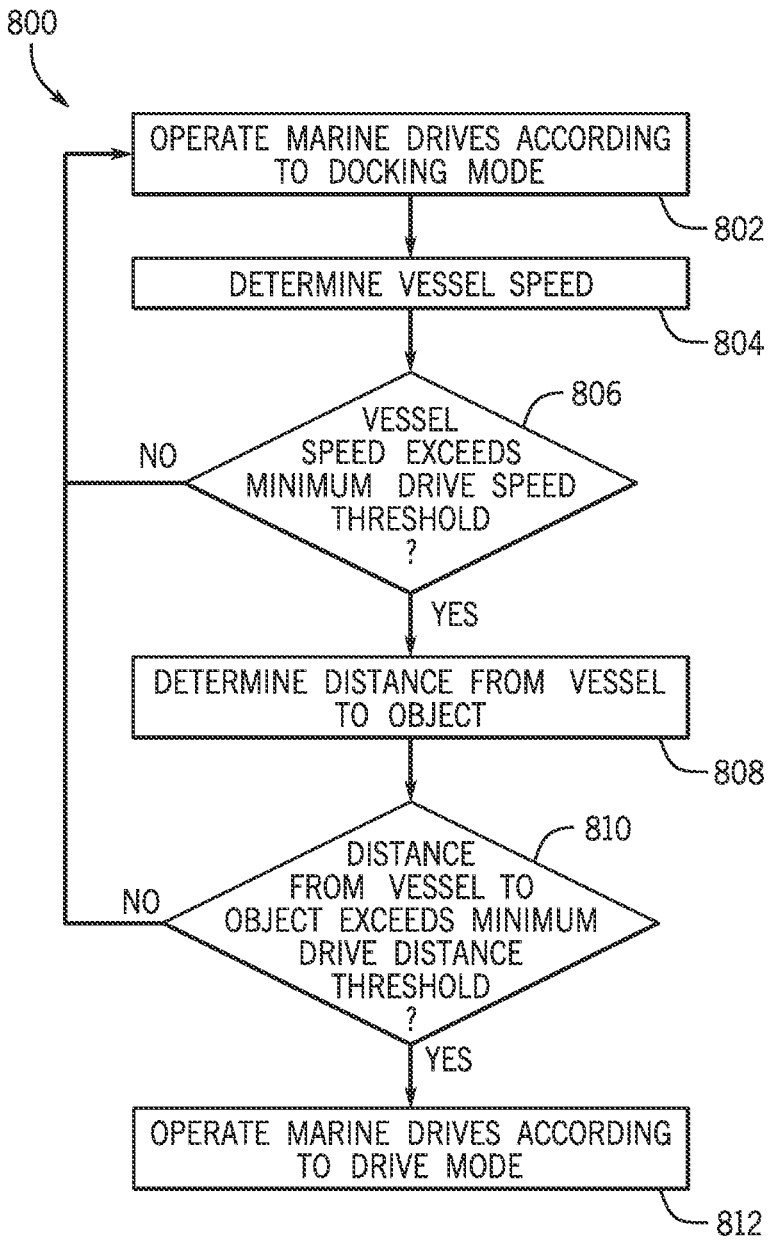
FIG. 8 illustrates a method of operating the propulsion system of the marine vessel during transition from the docking mode to the drive mode.

Referring now to FIG. 8, a method 800 is depicted of operating the propulsion control system 20 of the marine vessel 10 during transition from operation in the docking mode to operation in the drive mode. Method 800 is thus a specific implementation of method 700, described above with reference to FIG. 7, where the first operational mode of step 702 is the docking mode, and the second operational mode of steps 704-710 is the drive mode. Transition from the docking mode to the drive mode may occur, for example, when the marine vessel 10 moves away from a dock structure and its associated obstacles, accelerates, and enters open water.

Method 800 commences with step 802 as the CCM 24 operates the marine drives 12*a*, 12*b* according to the docking mode. As described above with reference to FIG. 5, when operating in the docking mode, the range 100 of movements of the joystick 30 that are assigned to pure forward and backward surge movements is relatively narrow as compared to the drive mode. In this way, the steering has high sensitivity to operator commands regarding sway movements. At step 804, the CCM 24 determines a speed of the marine vessel 10. The speed of the marine vessel 10 may be determined using any suitable sensing method, for example, using the speed of the engines 14*a*, 14*b*, or via feedback from sensors such as the IMU 36. Additional details regarding exemplary feedback control during low-speed propulsion of a marine vessel can be found in U.S. Pat. No. 10,926,855 hereby incorporated by reference herein in its entirety.

At step 806, the CCM 24 determines whether the vessel speed established in step 804 is greater than a predetermined minimum drive speed threshold. For example, in an exemplary embodiment, the minimum drive speed threshold may be six feet per second (FPS). If the vessel speed is not greater than the predetermined minimum drive speed threshold, method 800 reverts to step 802 and the CCM 24 continues to operate the propulsion control system 20 according to the docking mode. If, however, the CCM 24 determines that the vessel speed exceeds the minimum drive speed threshold, method 800 advances to step 808 and the CCM 24 determines a distance from the vessel 10 to an object O. The designation of the object O is not particularly limited, and may be a particular object (e.g., a dock structure), or simply the object, structure, or vessel nearest the marine vessel 10. Sensing of the distance to the object O may be achieved using any sensing devices provided on the vessel 10 (e.g., cameras, proximity sensors 72-78).

At step 810, the CCM 24 determines whether the distance from the vessel 10 to the object O detected at step 808 exceeds a minimum drive distance threshold (e.g., 20 feet). In an exemplary embodiment, the minimum drive distance threshold may be the length of the marine vessel 10. It is important to note that the order of steps 804-810 is not compulsory, and in other embodiments, steps 808 and 810 to determine whether the distance from the vessel 10 to the object O exceeds a minimum drive distance threshold may be performed before steps 804 and 806 to determine whether the vessel speed exceeds the minimum drive speed threshold.

If the sensed distance does not exceed the minimum threshold, method 800 reverts to step 802. If, however, the CCM 24 determines that the distance exceeds the minimum drive distance threshold, method 800 advances and concludes at step 812, in which the CCM 24 operates the marine drives 12*a*, 12*b*, according to the drive mode. As described above with reference to FIG. 6, when operating in drive mode, the CCM 24 will interpret user input commands of the joystick handle 44 within the second range 102 as commands for pure surge movement, and will operate the marine drives 12*a*, 12*b* in parallel to achieve such thrust outputs. In addition, when operating in drive mode, the CCM 24 may impose a higher maximum forward and reverse speed limit on the marine drives 12*a*, 12*b* than when operating in docking mode. The CCM 24 will continue to operate the marine drives 12*a*, 12*b* in the drive mode per step 812 so long as the vessel speed and the distance from the vessel 10 to the object O remain above the minimum drive speed and drive distance thresholds. In an exemplary embodiment, the minimum drive speed and distance thresholds utilized for switching from the docking mode to the drive mode are higher than maximum docking speed and distance thresholds utilized for switching from the drive mode to the docking mode (see FIG. 9 below) to avoid frequent toggling between modes when the relevant speed and distance values are near the thresholds.

Figure 9:
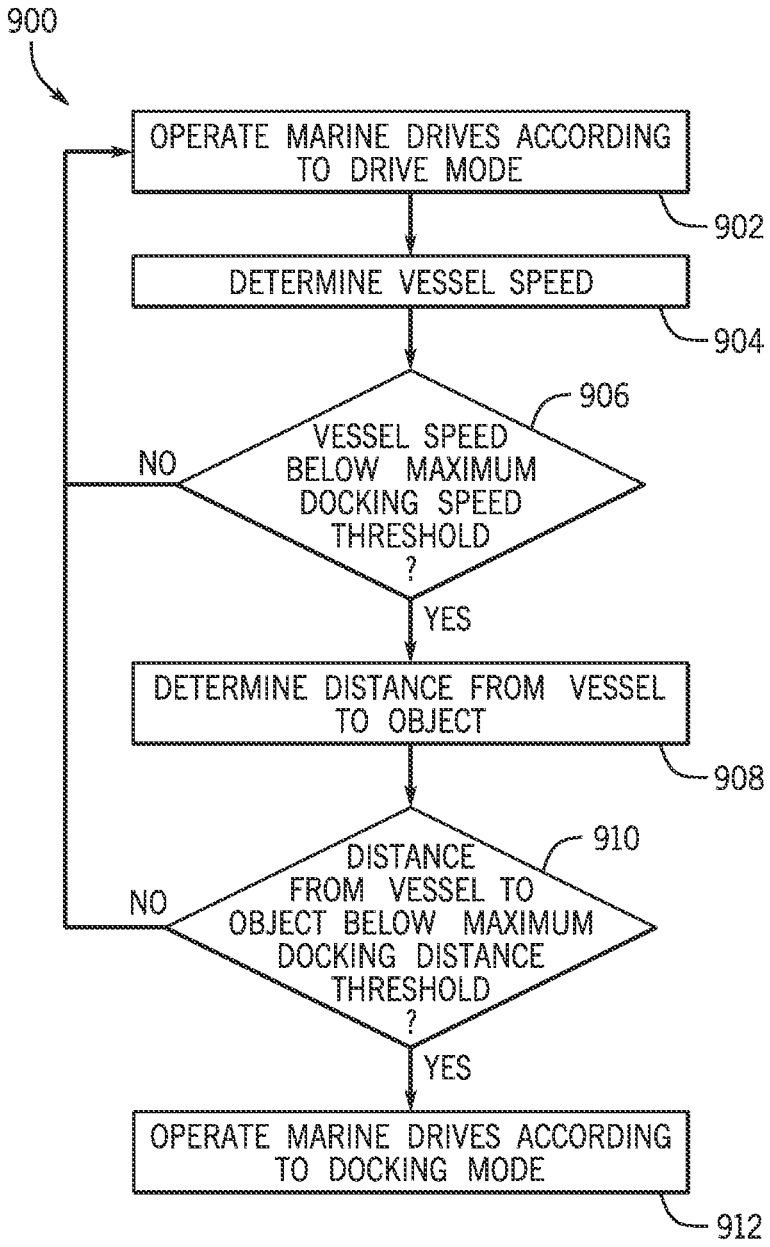
FIG. 9 illustrates a method of operating the propulsion system of the marine vessel during transition from the drive mode to the docking mode.

Turning now to FIG. 9, a method 900 of operating the propulsion control system 20 of the marine vessel 10 during transition from operation in the docking mode to operation in the drive mode is depicted. Method 900 is thus another specific implementation of method 700, described above with reference to FIG. 7, where the first operational mode of step 702 is the drive mode, and the second operational mode of steps 704 and 708-710 is the docking mode. Transition from the drive mode to the docking mode may occur when the marine vessel 10 moves from open water to the vicinity of a dock structure.

Method 900 commences with step 902 as the CCM 24 operates the marine drives 12*a*, 12*b* according to the drive mode. As described above with reference to FIG. 6, when operating in the drive mode, the range 102 of movements of the joystick 30 that are assigned to pure forward and backward surge movements is relatively broad as compared to the docking mode. At step 904, the CCM 24 determines a speed of the marine vessel 10, and at step 906, the CCM 24 determines whether the vessel speed established in step 904 is less than a predetermined maximum docking speed threshold. In some embodiments, the maximum docking speed threshold is the same value as the minimum drive speed threshold of step 806 (FIG. 8), but in other embodiments, they are different values to prevent unwanted frequent oscillation between the docking and drive modes. For example, as described above, the maximum docking speed and distance thresholds are lower than the minimum drive speed and distance thresholds according to an exemplary embodiment.

If the vessel speed is not below the predetermined maximum docking speed threshold, method 900 reverts to step 902 and the CCM 24 continues to operate the propulsion control system 20 according to the drive mode. If, however, the CCM 24 determines that the vessel speed is below the maximum docking speed threshold, method 900 advances to step 908 and the CCM 24 determines a distance from the vessel 10 to an object O.

At step 910, the CCM 24 determines whether the distance from the vessel 10 to the object O detected at step 908 is below a maximum docking distance threshold. Similar to the maximum docking speed threshold, in some embodiments, the maximum docking distance threshold may be the same value as the minimum drive distance of step 810, but in other embodiments, they may be different values. The order of steps 904-910 is not compulsory, and in other embodiments, steps 908 and 910 to determine whether the distance from the vessel 10 to the object O is below a maximum distance threshold may be performed before steps 904 and 906 to determine whether the vessel speed is below the maximum docking speed threshold.

If the sensed distance is not below the maximum threshold, method 900 reverts to step 902. If, however, the CCM 24 determines that the distance is below the maximum docking distance threshold, method 900 advances and concludes at step 912, in which the CCM 24 operates the marine drives 12*a*, 12*b*, according to the docking mode. As described above with reference to FIG. 5, when operating in docking mode, the CCM 24 will interpret user input commands of the joystick handle 44 only within the first range 100 as commands for pure surge movement, and thus will be more likely to operate the marine drives 12*a*, 12*b* in non-parallel configurations to achieve commanded sway thrust outputs.

Figure 10:
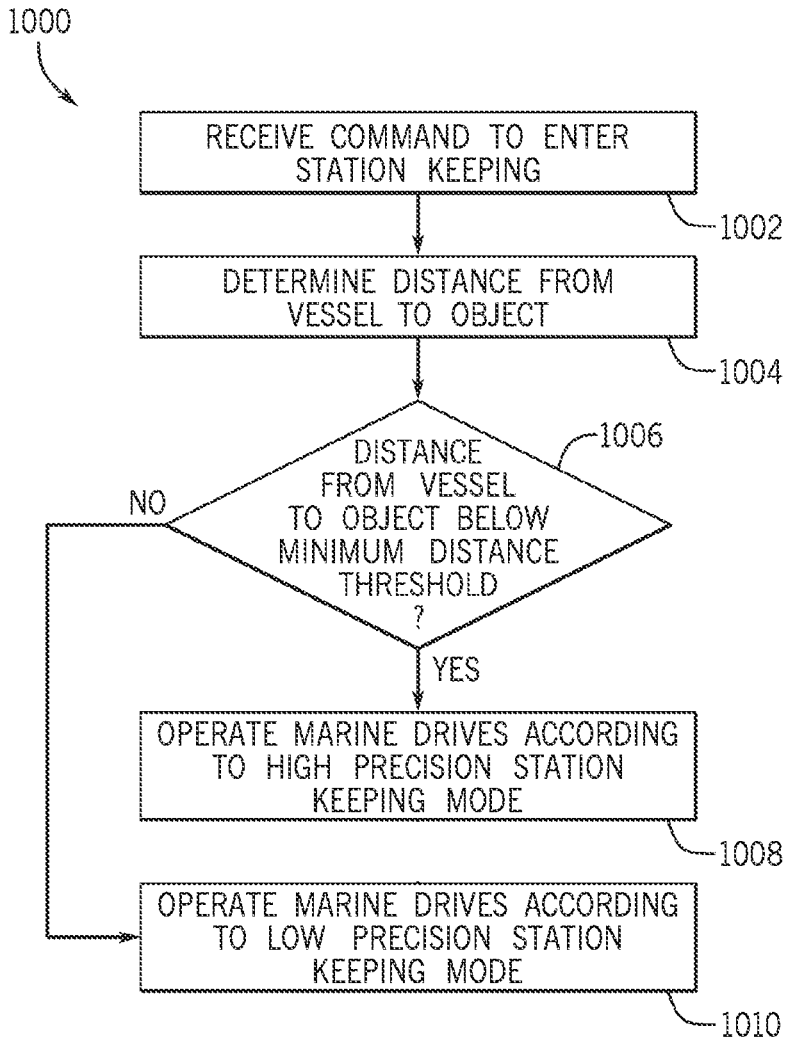
FIG. 10 illustrates a method of operating the propulsion system of the marine vessel in high and low reactivity station keeping modes.

Turning from transition between docking and drive operational modes to low and high precision station keeping modes, FIG. 10 depicts a method 1000 of operating the propulsion control system 20 during station keeping by automatically selecting and implementing a high precision or low precision mode. In either of the operational modes, when station keeping is activated, the marine vessel 10 can be maintained in a single global position (defined by latitude and longitude) and at a predetermined heading by way of algorithm that controls the marine drives 12*a*, 12*b* to counteract the effects of wind, waves, current, etc. that would tend to move the vessel 10 off this location and/or to a new heading. In other words, the marine drives 12*a*, 12*b* are controlled to maintain the vessel 10 at a virtual anchor point.

According to existing methods, an operator may affirmatively select between the high and low precision modes by operating a user interface device (e.g., actuating a push button on the keypad 29 or moving joystick 30 in a particular direction) While operating in the high precision station keeping mode, the error thresholds triggering the CCM 24 to complete a correction action of the position and/or heading using the marine drives 12*a*, 12*b* may be lower than when operating in the low precision mode. This is because the high precision station keeping mode may be best utilized when the marine vessel 10 is located in tight proximity to other vessels, dock structures, or obstacles, and minimization of drift is required. By contrast, the low precision station keeping mode may be best utilized when the marine vessel 10 is operating in open water conditions, and minimization of NVH associated with correction actions is desired.

Method 1000 commences at step 1002, as the CCM 24 receives a command to enter station keeping. In various implementations, the command to enter station keeping may be based on a user input received at the keypad 29 or the joystick 30. At step 1004, the CCM 24 determines a distance from the marine vessel 10 to at least one object O. In various embodiments, the object O may an object in or around the body of water (e.g., a dock structure, another vessel), or it may be the seabed such that the distance from the marine vessel 10 to the at least one object O is a depth measurement of the water proximate the marine vessel 10.

Proceeding to step 1006, the CCM 24 determines whether the distance to the at least one object O from step 1004 is less than a minimum distance threshold. If the CCM 24 determines that the distance is less than the minimum distance threshold, and thus more frequent and reactive correction of the vessel's position and/or heading is desirable to avoid collision, method 1000 advances to step 1008 and the CCM 24 operates the marine drives 12*a*, 12*b* according to the high precision operating mode. In an exemplary embodiment, while operating in the high precision operating mode, the CCM 24 may determine the error between a target position and heading and the vessel's actual position and heading and command the marine drives 12*a*, 12*b* to correct the vessel's position and/or heading if a high precision error threshold is exceeded, where the high precision error threshold is smaller than a low precision error threshold.

Returning to step 1006, if the CCM 24 determines at step 1006 that the distance to the at least one object O is greater than the minimum distance threshold, the CCM 24 operates the marine drives 12*a*, 12*b* according to the low precision operating mode. While operating in the low precision operating mode, the CCM 24 may determine the error between a target position and heading and the vessel's actual position and heading and command the marine drives 12*a*, 12*b* to correct the vessel's position and/or heading if the low precision error threshold is exceeded, where the low precision error threshold is larger than the high precision error threshold. In various embodiments, steps 1004-1010 may be repeatedly periodically while the CCM 24 is operating the propulsion control system in station keeping mode. In this way, if the CCM 24 is operating in low precision mode and the vessel 10 begins to drift too close to an object, for example, a dock structure, the CCM 24 can automatically transition to high precision mode to keep tighter control on the position of the vessel 10 and avoid collision. In still further embodiments, additional vessel characteristics may be sensed and utilized to determine whether to operate the propulsion control system 20 in low or high precision mode: for example, if a roughness condition of the water proximate the vessel 10 indicates very choppy conditions, the CCM 24 may operate in low precision mode because any position or heading correction actions undertaken by the marine drives 12*a*, 12*b* would be difficult to maintain.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A method for controlling propulsion of a marine vessel powered by a marine propulsion system including a plurality of marine drives, the method comprising:

determining a vessel speed and a distance from the marine vessel to an object while operating the plurality of marine drives according to a first operational mode;

automatically switching to a second operational mode based on the vessel speed and/or the distance from the marine vessel to the object;

receiving a user input from a user input device;

interpreting the user input based on the second operational mode; and controlling a propulsion output of the plurality of marine drives according to the second operational mode;

wherein the switching from the first operational mode to the second operational mode is not based on any user input from the user input device; and wherein:

the second operational mode comprises a drive mode based on a determination that the vessel speed exceeds a minimum drive speed threshold and the distance from the marine vessel to the object exceeds a minimum drive distance threshold; or the second operational mode comprises a docking mode based on a determination that the vessel speed does not exceed a maximum docking speed threshold and the distance from the marine vessel to the object does not exceed a maximum docking distance threshold.

2. The method of claim 1, wherein the first operational mode is one of the docking mode and the drive mode, and wherein the second operational mode is the other of the docking mode and the drive mode.

3. A method for controlling propulsion of a marine vessel powered by a marine propulsion system including a plurality of marine drives, the method comprising:

determining at least one vessel characteristic while operating the plurality of marine drives according to a first operational mode;

automatically switching to a second operational mode based on the at least one vessel characteristic;

receiving a user input from a user input device;

interpreting the user input based on the second operational mode; and controlling a propulsion output of the plurality of marine drives according to the second operational mode;

wherein the switching from the first operational mode to the second operational mode is not based on any user input from the user input device; and wherein the first operational mode is one of a low precision station keeping mode and a high precision station keeping mode, and wherein the second operational mode is the other of the low precision station keeping mode and the high precision station keeping mode.

4. The method of claim 3, wherein the at least one vessel characteristic comprises at least one of a vessel speed, a water depth proximate the marine vessel, and a water roughness condition proximate the marine vessel.

5. The method of claim 1, wherein the user input device comprises a joystick.

6. The method of claim 5, wherein:

the second operational mode comprises the docking mode, and wherein controlling a propulsion output of the plurality of marine drives according to the second operational mode comprises assignment of movements of the joystick within a first range to a surge output; or the second operational mode comprises the drive mode, and wherein controlling a propulsion output of the plurality of marine drives according to the second operational mode comprises assignment of movements of the joystick within a second range to the surge output; and the second range is larger than the first range.

7. The method of claim 1, wherein:

the second operational mode comprises a high precision station keeping mode based on a determination that the distance from the marine vessel to the object does not exceed a minimum distance threshold.

8. A marine propulsion system for controlling propulsion of a marine vessel, the system comprising:

at least one marine drive configured to propel the marine vessel;

a user input device; and a controller configured to:

determine a vessel speed and a distance from the marine vessel to an object while operating the at least one marine drive according to a first operational mode;

automatically switch to a second operational mode based on the vessel speed and/or the distance from the marine vessel to the object;

receive a user input from the user input device;

interpret the user input based on the second operational mode; and control a propulsion output of the at least one marine drive according to the second operational mode;

wherein the switching from the first operational mode to the second operational mode is not based on any user input from the user input device; and wherein:

the second operational mode comprises a drive mode based on a determination that the vessel speed exceeds a minimum drive speed threshold and the distance from the marine vessel to the object exceeds a minimum drive distance threshold; or the second operational mode comprises a docking mode based on a determination that the vessel speed does not exceed a maximum docking speed threshold and the distance from the marine vessel to the object does not exceed a maximum docking distance threshold.

9. The system of claim 8, wherein the first operational mode is one of the docking mode and the drive mode, and wherein the second operational mode is the other of the docking mode and the drive mode.

10. The system of claim 8, wherein the user input device comprises a joystick.

11. The system of claim 10, wherein:

the second operational mode comprises a docking mode, and wherein controlling a propulsion output of the at least one marine drive according to the second operational mode comprises assignment of movements of the joystick within a first range to a surge output; or the second operational mode comprises a drive mode, and wherein controlling a propulsion output of the at least one marine drive according to the second operational mode comprises assignment of movements of the joystick within a second range to the surge output; and the second range is larger than the first range.

* * * * *